US010982160B2

(12) United States Patent
Miyata et al.

(10) Patent No.: US 10,982,160 B2
(45) Date of Patent: Apr. 20, 2021

(54) METHOD OF PREPARING COMBUSTIBLE OIL

(71) Applicant: Fusion Group Holdings Co., Ltd., Fukushima (JP)

(72) Inventors: Kenji Miyata, Tokyo (JP); Kishio Arita, Chiba (JP)

(73) Assignee: Fusion Group Holdings Co., Ltd., Fukushima (JP)

( * ) Notice: Subject to any disclaimer, the term of this patent is extended or adjusted under 35 U.S.C. 154(b) by 0 days.

(21) Appl. No.: 16/760,401

(22) PCT Filed: Oct. 29, 2018

(86) PCT No.: PCT/JP2018/040048

§ 371 (c)(1),
(2) Date: Apr. 29, 2020

(87) PCT Pub. No.: WO2019/088006

PCT Pub. Date: May 9, 2019

(65) Prior Publication Data

US 2020/0339899 A1 Oct. 29, 2020

(30) Foreign Application Priority Data

Nov. 1, 2017 (JP) ..... JP2017-211921

(51) Int. Cl.
*C10L 1/32* (2006.01)

(52) U.S. Cl.
CPC ..... *C10L 1/324* (2013.01); *C10L 2200/025* (2013.01); *C10L 2200/0295* (2013.01); *C10L 2200/0446* (2013.01); *C10L 2200/0484* (2013.01); *C10L 2250/06* (2013.01)

(58) Field of Classification Search
CPC ..... C10L 1/324; C10L 2200/025; C10L 2200/0295; C10L 2200/0446; C10L 2250/06; C10L 2200/0484
See application file for complete search history.

(56) References Cited

U.S. PATENT DOCUMENTS

| | | | |
|---|---|---|---|
| 4,744,797 | A | 5/1988 | Shimada et al. |
| 2005/0108926 | A1 | 5/2005 | Moy et al. |

FOREIGN PATENT DOCUMENTS

| | | | |
|---|---|---|---|
| JP | S5783593 | A | 5/1982 |
| JP | 60223896 | * | 11/1985 |
| JP | 2001019983 | A | 1/2001 |
| JP | 5255162 | B1 | 8/2013 |
| JP | 5362138 | B1 | 12/2013 |

(Continued)

OTHER PUBLICATIONS

Tawian Office Action dated Oct. 7, 2019 with English Translation.

(Continued)

*Primary Examiner* — Cephia D Toomer
(74) *Attorney, Agent, or Firm* — Carter, DeLuca & Farrell LLP; George Likourezos

(57) ABSTRACT

Provided is a method of preparing a combustible oil, the method comprising adding and mixing: a petroleum-based combustible oil; a water having an oxidation-reduction potential of −300 mV or lower, a pH of 9.0 or higher, and a dissolved hydrogen concentration of 0.8 ppm or higher; a fatty oil; and an activated carbon to obtain a mixture.

20 Claims, 6 Drawing Sheets

(56) References Cited

FOREIGN PATENT DOCUMENTS

| | | | |
|---|---|---|---|
| JP | 5783593 | B2 | 9/2015 |
| JP | 2018035205 | A | 3/2018 |
| TW | 200934862 | A | 8/2009 |
| WO | 2009038108 | A1 | 3/2009 |
| WO | 2010023717 | A1 | 3/2010 |
| WO | 2014087679 | A1 | 6/2014 |

OTHER PUBLICATIONS

International Search Report issued by the Japanese Patent Office actiong as the International Searching Authority in relation to International Application No. PCT/JP2018/040048 dated Jan. 22, 2019.
Taiwan Office Action dated Oct. 7, 2019.
Decision to Grant a Patent issued by the Japanese Patent Office in relation to Japanese Patent Application No. 2019-536607 dated Sep. 2, 2019, along with English language translation.
Office Action issued by the Eurasia Patent Office in connection with counterpart Eurasia Patent Application No. 202091079 in reference to International Patent Application No. PCT/JP2018/040048 dated Sep. 8, 2020. English Translation Attached.
Office Action issued by the Eurasia Patent Office in connection to Eurasia Patent No. 202091079, dated Jan. 19, 2021, with English translation attached.
Brazilian Office Action received by the Brazilian Patent Office in connection to Brazilian Application No. 1120200085391, dated Jan. 26, 2021, with English translation attached.
Al-Amrousi, F.A. et al., "Physicochemical characterization of emulsion fuel from fuel oil-water-charcoal and surfactants", ScienceDirect, vol. 75, Issue 10, Aug. 1996, pp. 1193-1198, Abstract only.

* cited by examiner

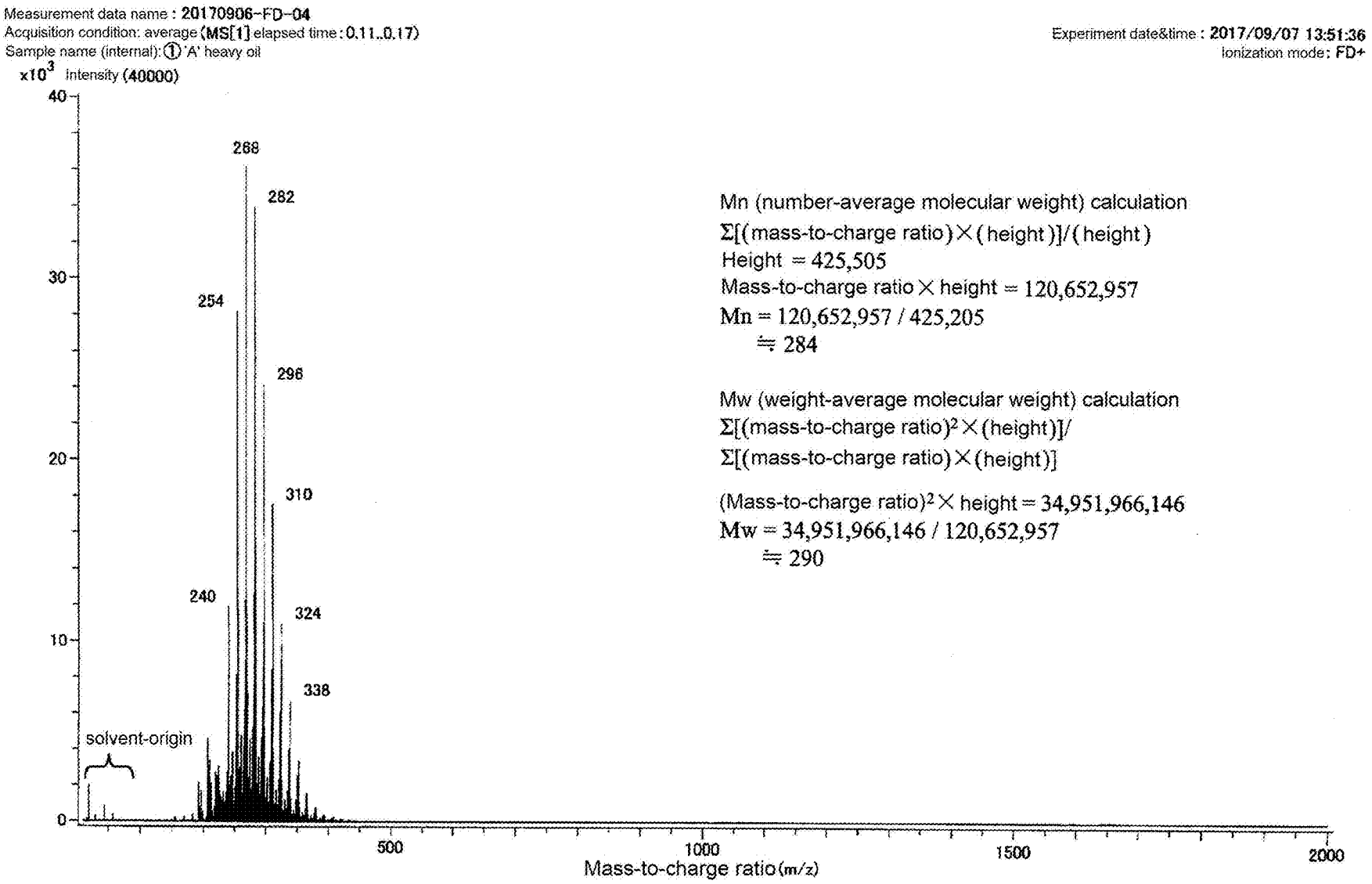

Mn (number-average molecular weight) calculation $\Sigma[(\text{mass-to-charge ratio}) \times (\text{height})]/(\text{height})$ Height = 425,505

Mass-to-charge ratio × height = 120,652,957

Mn = 120,652,957 / 425,205

≒ 284

Mw (weight-average molecular weight) calculation $\Sigma[(\text{mass-to-charge ratio})^2 \times (\text{height})]/$ $\Sigma[(\text{mass-to-charge ratio}) \times (\text{height})]$ $(\text{Mass-to-charge ratio})^2 \times \text{height}$ = 34,951,966,146

Mw = 34,951,966,146 / 120,652,957

≒ 290

Figure 1

Mn (number-average molecular weight) calculation
Σ[(mass-to-charge ratio)×(height)]/(height)
Height = 70,770
Mass-to-charge ratio × height = 19,793,201
Mn = 19,793,201 / 70,770
≒ 280

Mw (weight-average molecular weight) calculation
Σ[(mass-to-charge ratio)²×(height)]/
Σ[(mass-to-charge ratio)×(height)]

(Mass-to-charge ratio)² × height = 5,630,350,210
Mw = 5,630,350,210 / 19,793,201
≒ 284

General Incorporated Association
Nippon Kaiji Kentei Kyokai
Japanese government approved Headquarters
[redacted]

Offices
Major ports throughout the country

ORIGINAL
( Ref. AG )

Test Report

Yokohama
October 3, 2017
Report No.ZPE3384.2/17

Requester : Innova Industries Inc.
Sample names : 'A' Heavy Oil and Fule Oil (Clean Oil 'A' Heavy Oil)
Samples provided by : Requester Test Results :

| Test item | 'A' Heavy Oil | Fuel Oil | Test method |
|---|---|---|---|
| 1. Density @15℃, g/cm$^3$ | 0.8584 | 0.8643 | ASTM D4052 |
| 2. Flash point (PM), ℃ | 88.0 | 96.0 | ASTM D93 |
| 4. Pour point , ℃ | −21 | −18 | ASTM D97 |
| 5. Kinematic viscosity@50℃, mm$^2$/s | 2.688 | 3.534 | ASTM D445 |
| 6. Sulfur content, mass% | 0.388 | 0.330 | ASTM D4294 |
| 7. Water content (KF) , mg/kg | 113 | 167 | ASTM D6304 |
| 8. Ash, mass% | <0.001 | 0.001 | ASTM D482 |
| 9. Residual carbon content, mass% | 0.05 | 0.08 | ASTM D189 |
| 10. Calorific value , J/g | 45,280 | 44,675 | ASTM D240 |

General Incorporated Association Nippon Kaiji Kentei Kyokai
Physical and Chemical Analysis Center Director Hitoshi Yamamoto For questions about this report, contact : [redacted]

This certificate contains an anti-forgery treatment. If there is any doubt about the contents, check with the Original Report
This test was conducted by General Incorporated Foundation Nippon Kaiji Kentei Kyokai (ClassNK), which is recognized by Public Interest Incorporated Foundation Japan Accreditation Board (JAB), under the quality management system registered as being in conformity with ISO9001/JISQ9001.

KOP (C-1)

Figure 6

METHOD OF PREPARING COMBUSTIBLE OIL

CROSS-REFERENCE TO RELATED APPLICATIONS

This application is a national phase entry under 35 U.S.C. 371 of PCT International Application No. PCT/JP2018/040048 filed Oct. 29, 2018, which claims priority to Japanese Patent Application No. 2017-211921, filed Nov. 1, 2017, the disclosure of each of these applications is expressly incorporated herein by reference in their entirety.

TECHNICAL FIELD

The present invention relates to a combustible oil. More specifically, the present invention relates to a petroleum-based combustible oil, especially a petroleum-based fuel oil.

BACKGROUND ART

The petroleum-based fuel oils are used as sources of power, heat, light, electricity and the like. The petroleum-based fuel oils are so important that the modern industry could not possibly exist without them. Since the petroleum reserves are not unlimited, development of alternative energy sources is actively sought, but no alternative energy source has emerged that could eliminate the dependency on the petroleum-based fuel oils. For example, in a typical manufacturing industry, the purchasing of the petroleum-based fuel oils accounts for a large portion of the costs, and the current state is such that the fluctuations in the crude oil price have a major impact on the profits of the companies. The industries continue to face the problem of how to efficiently utilize the existing petroleum-based fuel oils.

Another problem associated with the petroleum-based fuel oils is that they contain undesirable impurities originating from the crude oils. For example, the sulfuric components in the fuels are known to produce harmful sulfuric compounds during the burning which become a major cause of the pollution and the environmental destruction. Other examples of the undesirable impurities include the nitrogenous components.

Technologies are known which use a fuel comprising oil and water wherein the water is comprised as a dispersed phase in the oil (e.g. Patent Document 1). This is called an emulsion fuel, a water-added fuel, etc., and since this fuel represents a reduction of oil content per fuel volume, it can provide the effect of reducing the petroleum-based fuel oil consumption as well as reducing the impurity concentrations. However, these technologies require the use of special apparatuses and/or emulsifiers (surfactants) to disperse water, which tend to make the preparation equipment more expensive or more complex. Further, these technologies may also have potential problems associated with the burning of the fuel in the presence of the extraneous chemical substance, namely the emulsifier.

The petroleum-based combustible oils may also be used for other purposes than fuel, for example as solvents (including cleaning liquids, extracting liquids, and the like).

CITATION LIST

Patent Documents

Patent Document 1: WO2014/087679

SUMMARY OF INVENTION

The present invention provides a novel method for preparing a new combustible oil based on a petroleum-based combustible oil.

The present inventors have discovered that a new combustible oil can be obtained by admixing: a petroleum-based combustible oil; a water having a negative oxidation-reduction potential, an alkaline pH, and some dissolved hydrogen; a fatty oil; and an activated carbon, wherein the new combustible oil has an increased volume compared to the oils that have been added. This discovery has led to the present invention.

In one embodiment, a method of preparing a combustible oil is provided, the method comprising admixing: a petroleum-based combustible oil; a water having a negative oxidation-reduction potential, an alkaline pH, and some dissolved hydrogen; a fatty oil; and an activated carbon. A composition for use in the method and the combustible oil prepared by the method are also provided.

More particularly, the present invention includes at least the following embodiments.

[1]

A method of preparing a combustible oil, the method comprising adding and mixing:

a petroleum-based combustible oil;

a water having an oxidation-reduction potential of −300 mV or lower, a pH of 9.0 or higher, and a dissolved hydrogen concentration of 0.8 ppm or higher;

a fatty oil; and an activated carbon to obtain a mixture.

[2]

The method of preparing a combustible oil according to [1], wherein the amount of the water added is 5 to 60% by volume relative to 100% of the total volume of the petroleum-based combustible oil and the water.

[3]

The method of preparing a combustible oil according to [1] or [2], further comprising adding magnesium chloride.

[4]

The method of preparing a combustible oil according to [3], wherein the amount of the magnesium chloride added is 0.005 to 0.5% (w/v) in terms of an anhydrous equivalent, relative to the water.

[5]

The method of preparing a combustible oil according to any one of [1] to [4], wherein the fatty oil comprises a vegetable oil.

[6]

The method of preparing a combustible oil according to any one of [1] to [5], wherein the fatty oil comprises a glyceride of an unsaturated fatty acid.

[7]

The method of preparing a combustible oil according to any one of [1] to [6], wherein the amount of the fatty oil added is 0.5 to10 parts by volume relative to 100 parts of the total volume of the water and the petroleum-based combustible oil.

[8]

The method of preparing a combustible oil according to any one of [1] to [7], wherein the activated carbon is a particulate activated carbon having a particle size smaller than 16 mesh.

[9]

The method of preparing a combustible oil according to any one of [1] to [8], wherein the amount of the activated carbon added is 0.1 to 5% (w/v) relative to the total volume of the water and the petroleum-based combustible oil.

[10]

The method of preparing a combustible oil according to any one of [1] to [9], further comprising adding a carbon nanotube.

[11]

The method of preparing a combustible oil according to any one of [1] to [10], comprising adding a partial mixture comprising a portion of the petroleum-based combustible oil and the activated carbon.

[12]

The method of preparing a combustible oil according to [11], wherein the water, the partial mixture, and the fatty oil are added and mixed, and then the remainder of the petroleum-based combustible oil is added and mixed stepwise.

[13]

The method of preparing a combustible oil according to any one of [1] to [12], further comprising removing solids, by filtrating a total mixture that has been obtained.

[14]

The method of preparing a combustible oil according to any one of [1] to [13], further comprising separating an oil phase and an aqueous phase to obtain the oil phase as a product oil.

[15]

A composition for preparing a combustible oil, for use in the method according to any one of [1] to [14], the composition comprising a petroleum-based combustible oil and an activated carbon.

According to the present invention, a new combustible oil can be prepared conveniently and cleanly from an existing combustible oil, wherein the new combustible oil can be utilized in similar ways to the original combustible oil but has an increased volume compared to the oils of the starting material. It is also possible to obtain a combustible oil having reduced concentrations of the sulfur and other impurities.

BRIEF DESCRIPTION OF DRAWINGS

FIGS. 1 to 5 show the data from the mass spectrometry analysis carried out for understanding and comparing the constituents of the 'A' heavy oil (input oil) sample and the product oil sample obtained in the Examples. FIG. 1 shows an FD-MS spectrum for the 'A' heavy oil sample.

FIG. 2 shows an FD-MS spectrum for the 'A' heavy oil sample and an expanded view of its m/z 200-400 region.

FIG. 3 shows an FD-MS spectrum for a sample of the product oil obtained in the Example.

FIG. 4 shows an FD-MS spectrum for a sample of the product oil obtained in the Example and an expanded view of its m/z 200-400 region.

FIG. 5 shows an FD-MS spectrum for a sample of the product oil obtained in the Example and an expanded view of its m/z 400-1000 region.

FIG. 6 is a copy of the test report on the general properties for a sample of the product oil obtained in the Example

DESCRIPTION OF EMBODIMENTS

Figure 2:
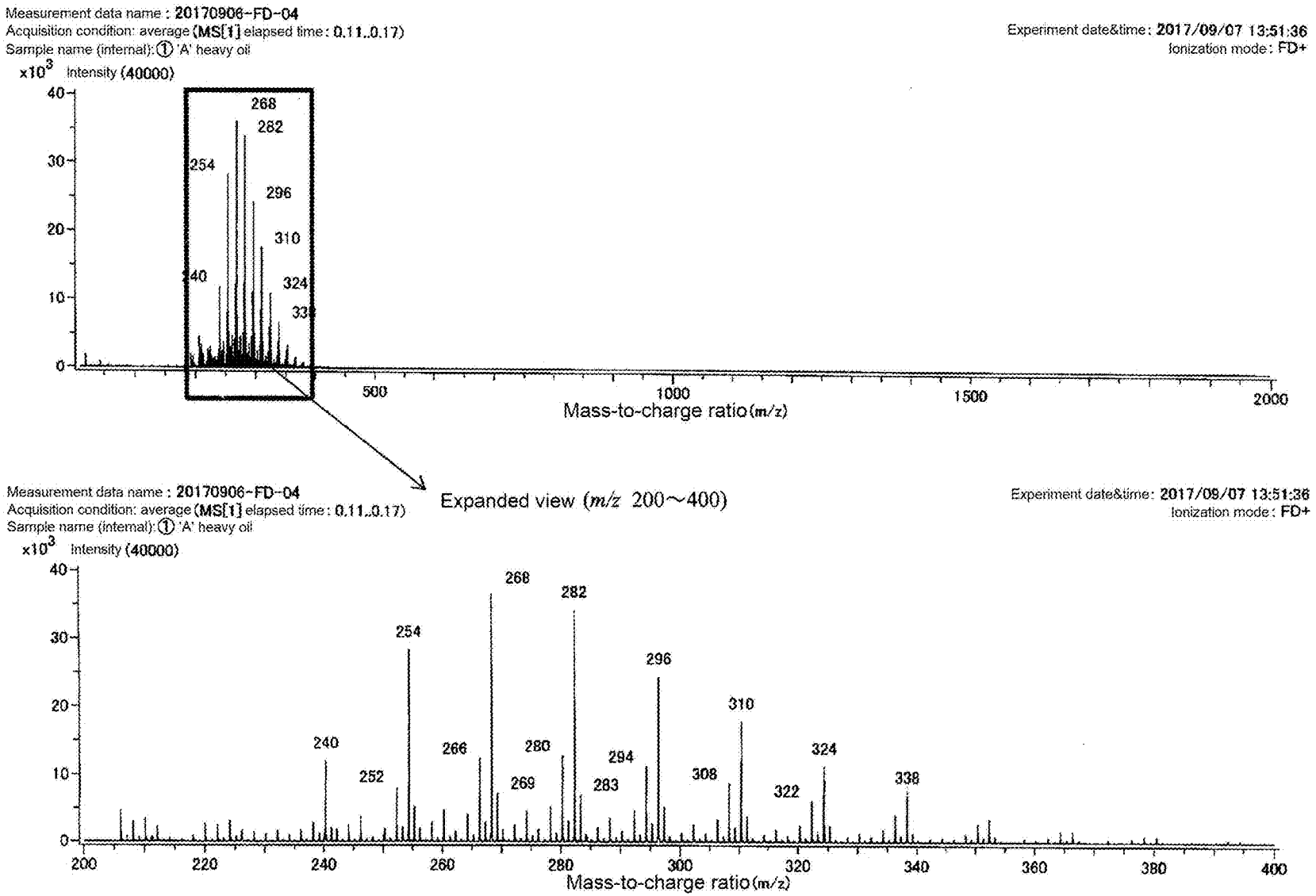

Embodiments of the method of preparing a combustible oil will be described below, the method comprising adding and mixing: a petroleum-based combustible oil; a water having a negative oxidation-reduction potential, an alkaline pH and some dissolved hydrogen; a fatty oil; and an activated carbon to obtain a mixture.

In the present embodiments, the petroleum-based combustible oil may refer to heavy oil, diesel oil (light oil), kerosene, naphtha, or gasoline, or any combination thereof. The gasoline herein may include the industrial gasolines used for non-fuel purposes. The standards for heavy oil, diesel oil, kerosene, and gasoline can be found in JIS K 2201 to 2206.

The petroleum-based combustible oil used in the present embodiments is preferably heavy oil, diesel oil, kerosene, or gasoline, and more preferably heavy oil or diesel oil. Among the heavy oils, 'A' heavy oil or 'C' heavy oil as defined by JIS K 2205 is especially preferable. The petroleum-based combustible oil used in the present embodiments may be a petroleum-based fuel oil. In the present embodiments, the term "used" can mean the subject is added as a component to be mixed with other component(s) in the act of obtaining the mixture as described above.

The combustible oil prepared by the present embodiments can be utilized as a fuel oil or a solvent, at least.

The water used in the present embodiments has an oxidation-reduction potential (ORP) of −300 mV or lower. "Having an oxidation-reduction potential of −300 mV or lower" means the oxidation-reduction potential is negative and its absolute value is 300 or greater (the unit being mV). Thus, this refers to a water that is reductive. The water used in the present embodiments may preferably have an oxidation-reduction potential of −400 mV or lower, more preferably −450 mV or lower, still more preferably −500 mV or lower, and especially preferably −600 mV or lower. No particular lower limit is stipulated to the oxidation-reduction potential of the water of the present embodiments. The oxidation-reduction potential of the water obtained by a commonly available means may typically be no lower than −800 mV, for example no lower than −790 mV, or no lower than −780 mV. The oxidation-reduction potential of the water can be measured by any methods known to a person skilled in the art. For example, oxidation-reduction potential can be measured by using the digital oxidation-reduction potential (ORP) meter YK-23RP (Mothertool Co., Ltd.).

The pH of the water used in the present embodiments is 9.0 or higher, more preferably 9.2 or higher, still more preferably 9.5 or higher, still more preferably 9.8 or higher, and especially preferably 10.0 or higher. No particular upper limit is stipulated to the pH of the water used in the present embodiments. The pH of the water used in the present embodiments is typically no higher than 12.0, for example no higher than 11.0, or no higher than 10.5. The pH of the water can be measured by any methods known to a person skilled in the art. For example, the pH can be measured by using the Standard pH Meter YK-21PH (Sato Shouji Inc.) with the PE-11 electrode.

The dissolved hydrogen concentration of the water used in the present embodiments is 0.8 ppm (or mg/L) or higher, preferably 0.9 ppm or higher, more preferably 1.0 ppm or higher, and still more preferably 1.2 ppm or higher. No particular upper limit is stipulated to the dissolved hydrogen concentration of the water used in the present embodiments. The dissolved hydrogen concentration of the water used in the present embodiments is typically no higher than 1.6 ppm, for example no higher 1.57 ppm, or no higher than 1.5 ppm. The dissolved hydrogen concentration of the water can be measured by any methods known to a person skilled in the art. For example, the dissolved hydrogen concentration can be measured by using the dissolved hydrogen concentration test reagent (MiZ Company Ltd.) or the portable dissolved hydrogen meter ENH-1000 (Trustlex Inc.).

The physicochemical mechanisms underlying the present invention are not elucidated. However, it appears that the method of the present invention can effectuate some kind of a reaction to produce a new oil or a new oil-soluble or oil-dispersible fraction which is combustible or non-interfering with combustion, to increase the volume of the oil phase compared to before the reaction. It is speculated that the above-mentioned oxidation-reduction potential, pH, and/or dissolved hydrogen can facilitate the reaction. Without wishing to be bound by a particular theory, it is at least considered probable that the water having an oxidation-reduction potential of −300 mV or lower may have a reduced surface tension which improves the affinity between the water and the oil to promote the reaction.

The water satisfying the requirements for the oxidation-reduction potential, the pH, and the hydrogen concentration (a.k.a. the water for preparing a combustible oil) can be prepared by using any means known to a person skilled in the art, either alone or in combination as appropriate. Examples of such means include the sintered materials comprising metallic magnesium (such as those described in JP 5664952 B), commonly called "ceramics balls", and the electrolyzing apparatuses. Tap water and natural water typically contain sufficient amounts of electrolytes and may be readily electrolyzed. Electrolytes can also be added to facilitate the electrolysis of water. The types and the amounts of the electrolytes suitable for obtaining a water satisfying the above-mentioned requirements are known to, or readily determined by, a person skilled in the art. An example of a suitable electrolyzing apparatus that is commercially available is TRIM AG-30 of Nihon Trim Co., Ltd. An example of a suitable ceramic ball that is commercially available is Hydrogen Reduction Ceramics Ball of Nagano Ceramics Corporation.

In one aspect, the present disclosure provides the water for preparing a combustible oil having the properties described above. In one example, the water for preparing a combustible oil is provided having an oxidation-reduction potential of −300 mV or lower, a pH of 9.0 or higher, and a dissolved hydrogen concentration of 0.8 ppm or higher. The water may comprise electrolytes and hydrogen molecules needed to satisfy these requirements. The water for preparing a combustible oil may further comprise magnesium chloride as described below.

In the present embodiments, the ratio between the petroleum-based combustible oil and the water may be varied. The amount of the water added may be for example 60% or lower, 55% or lower, 50% or lower, 45% or lower, or 40% or lower by volume relative to 100% of the total volume of the petroleum-based combustible oil and the water. If the water is added at a volume exceeding 60% of the said total volume, the excess water left out of the reaction may remain, but the reaction itself may occur. It has been observed that when the relative amount of the water is increased, the product oil yield per volume of the total mixture may decrease, but the product oil yield per volume of the input petroleum-based combustible oil may increase.

In the present embodiments, no particular lower limit is stipulated to the relative amount of the water. However, if the relative amount of the water is reduced too much, the beneficial result, i.e. the increased volume of the oil phase, may also be relatively reduced. The amount of the water added may be for example no lower than 5%, preferably no lower than 10%, more preferably no lower than 20%, and still more preferably no lower than 30% by volume relative to 100% of the total volume of the petroleum-based combustible oil and the water. In a preferable embodiment, the amount of the water added may be, but is not limited to, 5 to 60%, 10 to 50%, 20 to 45%, or 30 to 40% by volume relative to 100% of the total volume of the petroleum-based combustible oil and the water.

In the present embodiments, it is preferable to further use magnesium chloride because it can further increase the product yields. Magnesium chloride may be used in the anhydrous or hydrous form. In terms of efficiency, magnesium chloride is preferably first dissolved in the water and then, in the form of the aqueous solution, mixed with the other components. The physicochemical role played by the magnesium chloride is also not clear but it is speculated that the magnesium chloride could possibly facilitate the mixing between the water and the other components.

The amount (in terms of an anhydrous equivalent) of magnesium chloride added may be for example 0.005 to 0.5% (w/v), preferably 0.01 to 0.1% (w/v), and more preferably 0.015 to 0.05% (w/v), relative to the water.

The amount (in terms of an anhydrous equivalent) of magnesium chloride added may be for example 0.003 to 0.3% (w/v), preferably 0.005 to 0.1% (w/v), and more preferably 0.01 to 0.03% (w/v), relative to the petroleum-based combustible oil.

The amount (in terms of an anhydrous equivalent) of magnesium chloride added may be for example 0.001 to 0.1% (w/v), preferably 0.002 to 0.05% (w/v), and more preferably 0.005 to 0.02% (w/v), relative to the total volume of the water and the petroleum-based combustible oil.

It may also be possible to add magnesium chloride at an amount outside these ranges.

The fatty oil used in the present embodiments may comprise as a predominant component (typically 95% by weight or higher) a glyceride of saturated fatty acid(s), unsaturated fatty acid(s), or combination thereof. Inclusion of a glyceride having an unsaturated fatty acid moiety is preferable. Typically a fatty oil may also comprise trace amount components such as free fatty acids (typically at no higher than 5% by weight, preferably no higher than 1% by weight) and pigments. The glyceride can be triglyceride, diglyceride, or monoglyceride. Triglyceride is preferable. The number of the unsaturated bonds within the unsaturated fatty acid may be one, two, three, or four or more. Suitable unsaturated fatty acids may include, but are not limited to, monounsaturated fatty acids. The fatty acids may be short-chain fatty acids (with 5 or fewer carbons), medium-chain fatty acids (with 6 to 12 carbons), long-chain fatty acids (with 13 or more carbons), or a combination thereof. A medium-chain fatty acid is preferably included, and a long-chain fatty acid is more preferably included. The fatty acids typically have non-branched hydrocarbon chains. The hydrocarbon chain may be substituted with a substitution group such as a hydroxyl group. The glyceride is typically liquid at a normal temperature. That is, the fatty oil used in the present embodiments is typically liquid at room temperature (15 to 25° C.).

An example of a suitable fatty acid is oleic acid. Thus, the fatty oil used in the present embodiments preferably comprises a glyceride of oleic acid. For example, among the fatty acid components of the fatty oil, 10 to 50%, or more preferably 15 to 40% may be oleic acid (by moles).

The number of carbons or the number of unsaturations for the fatty acids in the fatty oil used in the present embodiments may affect the yields (yield rates), and using multiple types of fatty acids in combination may result in the increase of the yields. Without wishing to be bound by a particular theory, this could be due to an improvement in the mixed state of the total mixture caused by the slight modulations of the fatty acid structures. For example, using a fatty oil comprising only unsaturated fatty acids may be less advantageous than using it in combination with another fatty oil comprising a saturated fatty acid. Also, using an oleic acid glyceride alone may be less advantageous than using it in combination with a glyceride of another fatty acid. In a preferable example of the present embodiments, the fatty oil is composed of 10 to 15% saturated fatty acids and 85 to 90% unsaturated fatty acids.

The fatty oil is preferably a plant-based fatty oil. Suitable sources of the fatty oil include vegetable oils. In the present embodiments, the fatty oil may be admixed in the form of a vegetable oil. Thus, instead of or in addition to a purified or isolated form of a specific fatty acid glyceride, a vegetable oil may be used. Preferable vegetable oils include, but are not limited to, castor oil, coconut oil (copra oil), sunflower oil, rapeseed oil (canola oil), and any combinations thereof. Those obtained by fractionating or purifying a vegetable oil to enrich certain fatty acid components, for example palm olein, may also be suitably used. The fatty oil preferably comprises 20% (v/v) or more, more preferably 25% (v/v) or more, and more preferably 50% (v/v) or more of palm olein. In a preferable example, 25 to 80% (v/v) of the fatty oil is palm olein. In a preferable example, the fatty oil comprises palm olein and one or more other vegetable oils.

The amount of the fatty oil added is preferably 1 to 10 parts by volume, more preferably 1.5 to 8 parts by volume, and still more preferably 2 to 6 parts by volume, relative to 100 parts by volume of the petroleum-based combustible oil.

Alternatively, the amount of the fatty oil added is preferably 1 to 20 parts by volume, more preferably 2 to 15 parts by volume, and still more preferably 3 to 10 parts by volume, relative to 100 parts by volume of the water.

Alternatively, the amount of the fatty oil added is preferably 0.5 to 10 parts by volume, more preferably 0.7 to 7 parts by volume, and still more preferably 1 to 5 parts by volume, relative to 100 parts of the total volume of the water and the petroleum-based combustible oil.

It may also be possible to add the fatty oil at an amount outside these ranges.

The activated carbon used in the present embodiments is preferably in a particulate form, and preferably in a powder form as seen by the naked eye. With respect to the particle size, the activated carbon smaller than 16 mesh (Tyler) is preferable, the activated carbon smaller than 65 mesh is more preferable, the activated carbon smaller than 150 mesh is still more preferable, and the activated carbon smaller than 325 mesh is especially preferable. "Activated carbon smaller than 325 mesh" means an activated carbon in a particulate form whose particles can pass through the No. 325 mesh. The activated carbon having a median particle size of 8-15 μm or 6-10 μm as determined by laser diffraction particle size analysis may be most preferably used.

The present embodiments can be characterized by the step of slurry formation to undergo the mixing, the slurry comprising the water, the petroleum-based combustible oil, and the fatty oil, together with the activated carbon particles. It is believed that in this slurry, the mixing of the components is facilitated, enabling the appropriate reaction.

The amount of the activated carbon added may be preferably 0.2 to 10% (w/v), more preferably 0.5 to 5% (w/v), and still more preferably 1 to 3% (w/v), relative to the petroleum-based combustible oil.

Alternatively, the amount of the activated carbon added may be preferably 0.2 to 20% (w/v), more preferably 0.5 to 10% (w/v), and still more preferably 1 to 4% (w/v), relative to the water.

Alternatively, the amount of the activated carbon added may be preferably 0.1 to 5% (w/v), more preferably 0.2 to 3% (w/v), and still more preferably 0.5 to 1.2% (w/v), relative to the total volume of the water and the petroleum-based combustible oil.

It may also be possible to add the activated carbon at an amount outside these ranges.

It is preferable to further use a carbon nanotube in addition to the activated carbon. For example, a carbon nanotube having an average diameter of 10 to 15 nm and an average length of shorter than 10 μm as measured by transmission electron microscopy may be preferably used. A suitable specific surface area (BET) of the carbon nanotube is 180 to 250 $m^2/g$.

Preferably, 0.1 to 5 parts by weight, more preferably 0.2 to 3 parts by weight, and still more preferably 0.5 to 2 parts by weight of the carbon nanotube is used, relative to 100 parts by weight of the activated carbon.

In a preferable example of the present embodiments, the total mixture may comprise, based on the total amount of the water and the petroleum-based combustible oil, 1/200 to 1/10 the volume of the fatty oil, 0.1 to 5% (w/v) of the activated carbon, optionally 0.001 to 0.1% (w/v) of magnesium chloride, and optionally the carbon nanotube.

The petroleum-based combustible oil, the water, the fatty oil, the activated carbon, the optional magnesium chloride, and the optional carbon nanotube together account for preferably 90% or more, more preferably 95% or more, still more preferably 99% or more, and especially preferably 99.9% or more of the weight of the total mixture. Preferably, besides the above-mentioned components, a surfactant is not added into the total mixture of the present embodiments. A surfactant is an amphiphilic compound having a hydrophilic group and a hydrophobic group. A surfactant is typically an organic compound. The total mixture of the present embodiments may consist of the petroleum-based combustible oil, the water, the fatty oil, the activated carbon, the optional magnesium chloride, and the optional carbon nanotube.

In the present disclosure, a "total mixture" refers to a final mixture in which all the components that should be added have been added in their entirety, and a "partial mixture" refers to a mixture of two or more components which represent a portion of the entire components.

To mix the plurality of components described above into the total mixture, many different mixing sequences are possible, and some particular mixing sequences may be more advantageous than others in terms of efficiency. For example, as described above, the magnesium chloride is preferably first dissolved in the water and then, in the form of the aqueous solution, supplied into the final mixture.

The activated carbon is preferably provided as a partial mixture in which the activated carbon is suspended in a portion of the petroleum-based combustible oil, and then mixed into the total mixture. Such a partial mixture can be independently manufactured, stored, and provided as a "composition for preparing a combustible oil". Thus, in one aspect of the present disclosure, a composition for preparing a combustible oil, for use in the method of preparing the combustible oil according to the present disclosure, is provided. The "portion of the petroleum-based combustible oil" may be 1 to 50%, preferably 2 to 20%, and more preferably 3 to 10% of the total volume of the petroleum-based combustible oil to be added into the total mixture. This is typically equivalent to the amount of petroleum-based combustible oil which is 2 to 5 times the weight of the activated carbon. By providing the activated carbon in this manner as a suspension in the portion of the petroleum-based combustible oil, it is possible to realize the mode of operation in which the suspension of the carbonaceous components is kept as a ready-to-mix stock reagent and this stock reagent is added, as needed, to the remainder portion of the petroleum-based combustible oil and the water when they become available or become ready, which together constitute the greater part of the total mixture. Further, the activated carbon being first suspended in a portion of the petroleum-based combustible oil and then mixed with the other components may also be preferable for facilitating the mixing of the total mixture.

The petroleum-based combustible oils may sometimes have significantly different impurity (e.g. sulfur) contents depending on where they are obtained, for example depending on which countries they are purchased in. A special attention may be needed because if the composition for preparing a combustible oil contains a high sulfur petroleum-based combustible oil, for example, the technical effect of the present embodiments, i.e. the reduced sulfur contents in the final products, may not be obtained to its full potential.

In the composition for preparing a combustible oil described above, the petroleum-based combustible oil and the activated carbon preferably account for 90% or more, more preferably 95% or more, still more preferably 99% or more, and especially preferably 99.9% or more of the weight of the composition. The composition for preparing a combustible oil may consist only of the petroleum-based combustible oil and the activated carbon. These compositions for preparing a combustible oil typically comprise the petroleum-based combustible oil 2 to 5 times the weight of the activated carbon.

A composition for preparing a combustible oil comprising the fatty oil instead of or in addition to the petroleum-based combustible oil is also contemplated. In this case, the petroleum-based combustible oil, the activated carbon, and the fatty oil preferably account for 90% or more, more preferably 95% or more, still more preferably 99% or more, and especially preferably 99.9% or more of the weight of the composition. This composition for preparing a combustible oil typically comprises the petroleum-based combustible oil which is 2 to 5 times the weight of the activated carbon and the fatty oil which is ⅓ to 1 times the volume of the petroleum-based combustible oil.

In a particularly preferable example of the present embodiments, firstly, the water which optionally comprises magnesium chloride, a partial mixture which comprises the activated carbon and the petroleum-based combustible oil corresponding to 3 to 10% of the volume of all the petroleum-based combustible oil (e.g. diesel oil) eventually added into the total mixture, and the fatty oil are admixed. The remainder of the petroleum-based combustible oil may be added at once, but it is more preferable to add and mix it stepwise in two or more portions. For example, to the new partial mixture formed by the above-mentioned admixing, the petroleum-based combustible oil corresponding to 20 to 40% of the volume of all the petroleum-based combustible oil is added and mixed. Then, to this further partial mixture, the remainder of the petroleum-based combustible oil is added and mixed to form the total mixture. The optional carbon nanotube may be added in any steps or in any partial mixtures. By adding the petroleum-based combustible oil stepwise in this manner, the mixture will go through a thick slurry state having a high activated carbon concentration, which is believed to promote the reaction.

The mixing for the present embodiments can be carried out by any means known to a person skilled in the art. Typically, it is carried out by stirring. The stirring can be carried out manually, but it is preferable to use a mechanical stirrer, for example a screw-type stirrer. A homogenizer configured to perform stirring in the up-down directions in addition to the rotational directions about the axis is preferably used. Other means, for example a shaker, a nanomixer, or an ultrasonic homogenizer, may also be used to carry out the mixing. Any of these mixing means can be used alone or in combination.

The mixing is carried out to produce a mixture comprising or consisting of a uniform slurry. It is believed that the components are dispersed, suspended, and/or dissolved with each other in this slurry. When observed by the naked eye, this slurry may appear black due to the activated carbon, and may have a paste-like, a jelly-like, or a milky (in terms of consistency, rather than color) appearance. In particular, at the stage in which only a portion of the petroleum-based combustible oil has been added, a high-viscosity (i.e. thick) slurry is formed. Depending on the relative amount of the water added, separate aqueous droplets or aqueous clusters unable to blend with the bulk of the uniform mixture may be visible. It is preferable to perform the mixing with a sufficient shear force to make such aqueous droplets or clusters finer and eventually dissipate or disappear. The mixing is preferably carried out in a manner that minimizes the formation of visible bubbles. The possibility that the slurry contains aqueous droplets and/or bubbles that are too small to be seen by the naked eye is not excluded.

The mixing can be suitably carried out under a normal temperature (room temperature), but the mixing can also be carried out in the environments having different temperatures. A suitable temperature can be determined by a person skilled in the art as appropriate by considering e.g. the flash point of the petroleum-based combustible oil. For example, if a diesel oil is used for the petroleum-based combustible oil, a temperature of 40 to 50° C. can be suitably used for the mixing. If the temperature is too high, there may be an accelerated deterioration of the components.

The duration of the mixing may vary depending on the type of the mixing means but it is typically 5 minutes or longer, and preferably 10 minutes or longer. The mixing may be carried out for a longer period of time, for example 30 minutes or longer, 1 hour or longer, 10 hours or longer, or 1 day or longer. If the mixing is done in multiple steps as described above, each step or all steps in total may span any of these periods of time. In a preferable embodiment, the mixing in the state of the total mixture is carried out for 5 to 20 minutes.

After the mixing for a sufficient length of time to allow the reaction of the components, the solids may be removed, by filtering the mixture, to obtain an oil phase as a product, and typically an aqueous phase along with it. The oil phase herein means a phase that is distinct from the aqueous phase, and this does not exclude the possibility that a non-oil substance is dissolved and/or dispersed within the oil phase. The method of filtration may possibly involve passing through a filter paper simply by gravity, but it is more preferable to use a filter press. The oil phase can be separated from the aqueous phase by using a suitable means known to a person skilled in the art. Such means may include an oil-water separator and a centrifuge. The oil-water separation may also be carried out before the removal of the solids, i.e. while the solids are still present. The oil phase is typically obtained as a top layer.

The volume of this oil phase as a product (referred to as the product oil) may have been increased typically by 0.5% or more, preferably by 1% or more, more preferably by 2% or more, more preferably by 5% or more, more preferably by 10% or more, still more preferably by 20% or more, and especially preferably by 30% or more, compared to the volume of the oily fraction of the starting material (referred to as the input oil), i.e. the total volume of the petroleum-based combustible oil and the fatty oil.

This product oil may be usable for the same or similar purpose as the original petroleum-based combustible oil, for example as a fuel or as a solvent. Further, this product oil can be used as the input oil for the method described above. Thus, the petroleum-based combustible oil in the present disclosure may include the product oil obtained by the present method. Further, the product oil typically has a reduced sulfur content (concentration) compared to the original petroleum-based combustible oil. This reduction in the sulfur content can be at least partially explained by the dilution of the sulfur which was present in the original petroleum-based combustible oil, because the water and the fatty oil either have lower sulfur contents than the petroleum-based combustible oil or do not substantially contain sulfur. The sulfur content herein may be that measured according to ASTM D4294, ASTM D5453, or ASTM D2622-16. The amounts of other impurities than sulfur may be similarly reduced compared to the original petroleum-based combustible oil.

The sulfur content may be reduced for example by 3% or more, preferably by 3.5% or more, more preferably by 4% or more, more preferably by 5% or more, more preferably by 7.5% or more, more preferably by 10% or more, still more preferably by 15% or more, and especially preferably by 25% or more, compared to the original petroleum-based combustible oil.

In the present disclosure, the term "comprise", "contain", or "include" does not exclude the presence of the element(s) not explicitly stated. Also, the term may encompass an embodiment consisting only of the element(s) explicitly stated. Thus, the expression "X comprises A, B, and C", for example, may encompass an embodiment in which X includes D in addition to A, B, and C, as well as an embodiment in which X consists only of A, B, and C.

EXAMPLES

Below, Examples are presented to explain the various embodiments of the present invention in detail, but the present invention is not limited to these embodiments. All experiments of the following Examples were conducted under room temperature and the atmospheric pressure unless otherwise stated.

Example 1

The experiments of Example 1 were conducted manually in a smaller scale. Sixty-eight milli-grams of magnesium chloride anhydrate was dissolved in 350 mL water to obtain an aqueous solution. This water had had an oxidation-reduction potential of −505 mV, a pH of 9.6, and a dissolved hydrogen concentration of 1.2 ppm. Also, 8 g of activated carbon (particle size <325 mesh) was suspended in 32 mL of a commercial diesel oil to obtain Partial Mixture A. Separately, Partial Mixture B (fatty oil mixture) was obtained which consisted of 10 mL castor oil, 5 mL coconut oil and 5 mL palm olein. Partial Mixtures A and B were added to the aqueous solution, and after the stirring, a slurry was obtained.

Subsequently, 618 mL of a diesel oil was added and mixed by thorough stirring while the slurry state was maintained. After the stirring was continued for 10 minutes, the total mixture was filtered to remove the solids. The liquid phases were separated and the volumes were measured by visually inspecting the scales on the containers, which revealed the presence of 812.5 mL of an oil phase and 216 mL of an aqueous phase. This oil phase, i.e. the product oil, represented a 142.5 mL (21.3%) increase compared to the total volume of the input diesel oil and fatty oil.

Examples 2 to 10

The same experimental procedures were followed as in Example 1, except the conditions were varied as shown in Table 1 below. In Examples 4 to 10, the carbon nanotube in addition to the activated carbon was suspended in Partial Mixture A. The carbon nanotube was FT9100 CNT from Cnano Technology Ltd., having an average diameter of 10 to 15 nm, lengths of shorter than 10 μm, a specific surface area (BET) of 180 to 250 $m^2/g$, and a tapped density of 0.13±0.02 $g/cm^3$. In each case, a product oil was obtained at a high yield.

TABLE 1

| | Water | | | Magnesium chloride | Partial Mixture A | | | | | | |
|---|---|---|---|---|---|---|---|---|---|---|---|
| Example | Redox potential (mV) | pH | Dissolved hydrogen (ppm) | (mg/350 mL water) | Activated carbon | Carbon nanotube (mg/8 g act. carbon) | Partial Mixture B | | | Product oil (mL) | Aqueous phase (mL) |
| 1 | −505 | 9.6 | 1.2 | 68 | <325 mesh | | Castor oil 10 mL | Coconut oil 5 mL | Palm olein 5 mL | 812.5 | 216 |
| 2 | −580 | 9.5 | 1.2 | 68 | <325 mesh | | Castor oil 10 mL | Palm olein 10 mL | | 835 | 192 |
| 3 | −530 | 9.5 | 1.1 | 80 | <325 mesh | | Palm olein 10 mL | Sun-flower oil 10 mL | | 862 | 155 |
| 4 | −590 | 9.8 | 1.2 | 80 | <325 mesh | 50 | Palm olein 10 mL | Coconut oil 5 mL | Sun-flower oil 5 mL | 896 | 124 |
| 5 | −633 | 10.2 | 1.3 | 80 | <325 mesh | 60 | Palm olein 10 mL | Coconut oil 5 mL | Rapeseed oil 5 mL | 903 | 127 |

TABLE 1-continued

| Example | Water: Redox potential (mV) | Water: pH | Water: Dissolved hydrogen (ppm) | Magnesium chloride (mg/350 mL water) | Partial Mixture A: Activated carbon | Partial Mixture A: Carbon nanotube (mg/8 g act. carbon) | Partial Mixture B | | | Product oil (mL) | Aqueous phase (mL) |
|---|---|---|---|---|---|---|---|---|---|---|---|
| 6 | −680 | 10.5 | 1.3 | 100 | Size 8~15 | 50 | Palm olein 10 mL | Coconut oil 5 mL | Rapeseed oil 5 mL | 920 | 125 |
| 7 | −700 | 10.5 | 1.3 | 100 | Size 8~15 | 60 | Palm olein 12 mL | Coconut oil 8 mL | | 933 | 113 |
| 8 | −750 | 10.5 | 1.5 | 100 | Size 8~15 | 60 | Palm olein 13 mL | Coconut oil 7 mL | | 955 | 96 |
| 9 | −780 | 9.8 | 1.5 | 100 | Size 6~10 | 70 | Palm olein 14 mL | Coconut oil 6 mL | | 962 | 58 |
| 10 | −780 | 9.8 | 1.5 | 100 | Size 6~10 | 80 | Palm olein 15 mL | Coconut oil 5 mL | | 985 | 48 |

Example 11

Example 11 was carried out in an automated, specialized manufacturing plant. Four-hundred ninety-eight liters of a commercial diesel oil (55° C.) was introduced to a homogenizer-stirrer, and then 20 L of Partial Mixture A (55° C.) and 10 L of Partial Mixture B (55° C.) were introduced to the homogenizer-stirrer, and stirring was carried out for 5 minutes. The stirring temperature in this example was 45° C. Partial Mixture A consisted of a suspension of 32 L diesel oil and 8 kg activated carbon (median particle size 8 to 15 μm). Partial Mixture B consisted of 70% RBD palm olein and 30% coconut oil. Next, 60 L of a water (35° C.) having an oxidation-reduction potential of −720 mV, a pH of no lower than 9.0, and a dissolved hydrogen concentration of no lower than 0.8 ppm was introduced 3 times (total 180 L), each time followed by stirring for 3 minutes. Further 20 L of Partial Mixture A and 10 L of Partial Mixture B were introduced, each time followed by stirring for 5 minutes. Further 60 L of the water was introduced followed by stirring for 3 minutes, and still another 60 L of the water was introduced, and after the final 7 minute stirring, the mixture was filtered by using a filter press. The volume of the oil phase obtained by separating the filtrate by an oil-water separator was 742 L. The oil phase was clear and not turbid. This oil phase, i.e. the product oil, represents a 192 L (35%) increase compared to the total volume of the input diesel oil and fatty oil.

Examples 12 to 15

The process was repeated with same procedures as in Example 11, except for the differences in the conditions in detail as shown in Table 2 below. In each case, a product oil was obtained at a high yield.

TABLE 2

| Example | Water redox pot. (mV) | Water temp. (° C.) | Diesel oil temp. (° C.) | Stirring temp. (° C.) | Introduction to the stirrer (Stirring time (min.)) Step 1 | Step 2 | Step 3 | Step 4 | Step 5 | Step 6 | Step 7 | Step 8 | Product oil (L) |
|---|---|---|---|---|---|---|---|---|---|---|---|---|---|
| 11 | −720 | 35 | 55 | 45 | Diesel: 498 L | A: 20 L, B: 10 L (5) | Water: 60 L (3) | Water: 60 L (3) | Water: 60 L (3) | A: 20 L, B: 10 L (5) | Water: 60 L (3) | Water: 60 L (7) | 742 |
| 12 | −686 | 35 | 55 | 45 | Diesel: 498 L | A: 20 L, B: 10 L (3) | Water: 60 L (3) | Water: 60 L (3) | Water: 60 L (3) | A: 20 L, B: 10 L (5) | Water: 60 L (3) | Water: 60 L (7) | 763 |
| 13 | −736 | 37 | 58 | 48 | Diesel: 498 L | A: 20 L, B: 10 L (3) | Water: 60 L (3) | Water: 60 L (3) | A: 10 L, B: 10 L (5) | Water: 60 L (3) | Water: 60 L (3) | A: 10 L, B: 10 L, water: 60 L (7) | 780 |
| 14 | −731 | 38 | 60 | 50 | Diesel: 498 L | A: 20 L, B: 10 L (3) | Water: 60 L (3) | Water: 60 L (3) | A: 10 L, B: 10 L (5) | Water: 60 L (3) | Water: 60 L (3) | A: 10 L, B: 10 L, water: 60 L (10) | 789 |
| 15 | −773 | 40 | 60 | 52 | Diesel: 498 L | A: 20 L, B: 10 L (3) | Water: 60 L (3) | Water: 60 L (3) | A: 10 L, B: 10 L (5) | Water: 60 L (3) | Water: 60 L (3) | A: 10 L, B: 10 L, water: 60 L (10) | 806 |

Example 16

Example 16 is an example using the 'A' heavy oil. Thirty-five milli-liters of a water having an oxidation-reduction potential of −629 mV, a pH of 9.8 and a dissolved hydrogen concentration of no lower than 0.8 ppm, 6 mL of Partial Mixture A, 3 mL of Partial Mixture B, and 10 mL of a commercial 'A' heavy oil were stirred thoroughly for 10 minutes. In this Example this is called the initial stirring. Partial Mixture A was a suspension of 4.8 mL 'A' heavy oil and 1.2 g activated carbon (size 8-15 powder). Partial Mixture B consisted of 2.4 mL RBD palm olein and 0.6 mL coconut oil. Subsequently, the remainder of the 'A' heavy oil 55 mL was added and stirring was carried out for 5 minutes. This is called the final stirring. The initial stirring was carried out with sufficient speed and shear force to render the mixture into a paste-like state or a milky state (in terms of consistency, rather than color). The final stirring was milder in comparison. The obtained mixture was filtrated through a filter paper to remove the solids, which resulted in the recovery of 95 mL oil phase. This oil phase, i.e. the product oil, represents a 22.2 mL (30.5%) increase compared to the total volume of the input 'A' heavy oil and fatty oil.

Examples 17 to 25

Experiments were carried out with the same procedures as in Example 16 except for the differences in the conditions in detail as shown in Table 3 below. In each case a product oil was obtained at a high yield

TABLE 3

| | Water | | | |
|---|---|---|---|---|
| Example | Redox potential (mV) | pH | Initial stirring (min) | Product oil (mL) |
| 16 | −629 | 9.8 | 10 | 95 |
| 17 | −633 | 10.0 | 10 | 102 |
| 18 | −638 | 10.1 | 10 | 98 |
| 19 | −641 | 9.9 | 10 | 96 |
| 20 | −640 | 9.8 | 15 | 102 |
| 21 | −645 | 10.2 | 15 | 102 |
| 22 | −646 | 10.1 | 15 | 101 |
| 23 | −645 | 10.0 | 15 | 105 |
| 24 | −647 | 10.2 | 15 | 103 |
| 25 | −648 | 10.2 | 20 | 103 |

A sample of the product oil obtained as in Examples 16 to 25 was analyzed by Field Desorption Mass Spectroscopy (FD-MS) to measure the molecular weights of the constituents.

More specifically, a sample of the 'A' heavy oil used as the starting material and a sample of the product oil obtained in the Example were each placed in a sample vial and diluted two-fold with the THF solvent. FD-MS measurements were made for these solutions. For the measuring device, the model JMS-T100GCV (a product of JEOL, Ltd.) was used. The measuring conditions were as follows.

Cathode voltage: −10 kV

Emitter current: 0 mA→51.2 mA/min→35 mA

Mass range analyzed: m/z 10-2000

Figure 3:
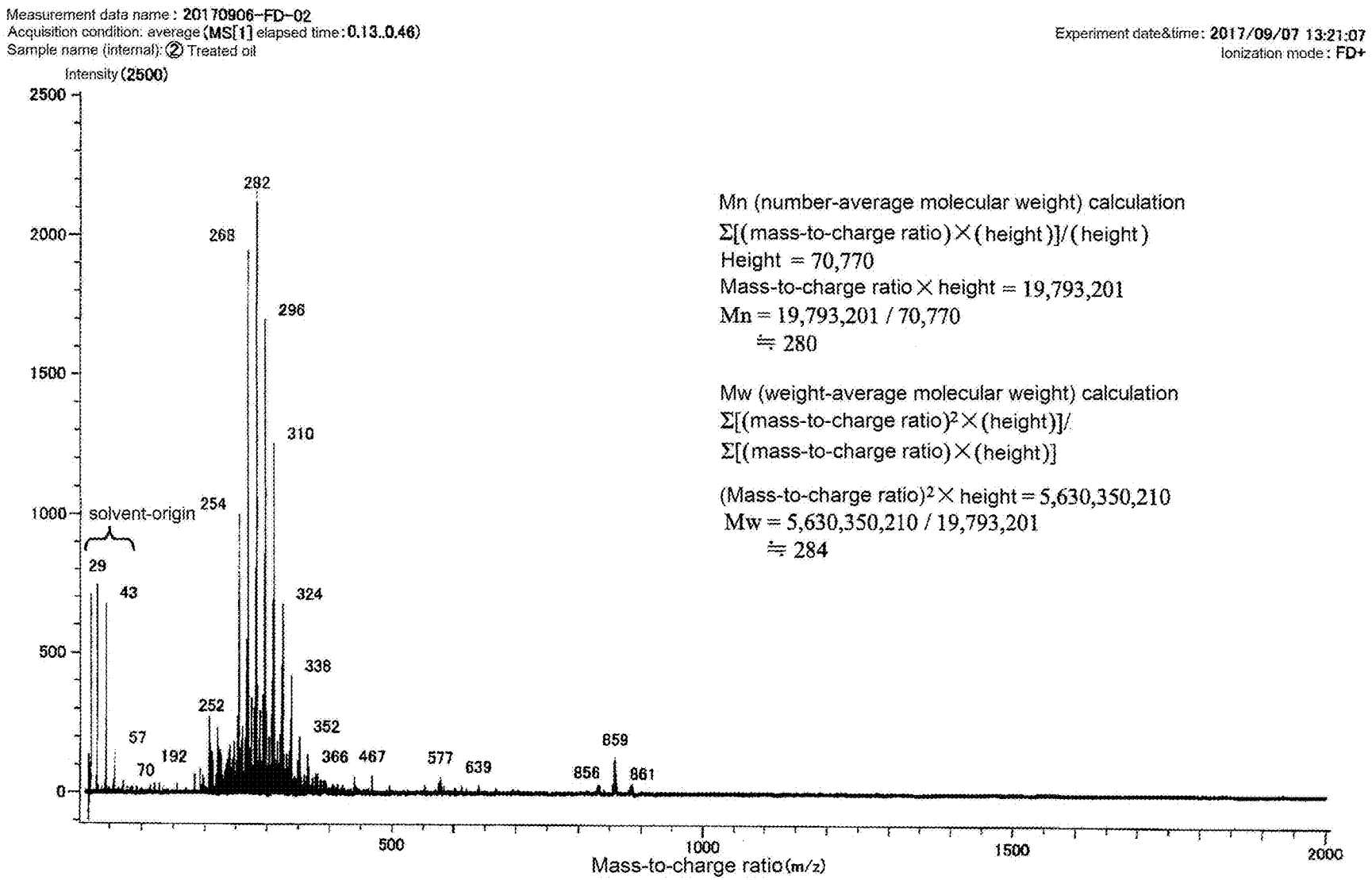
Figure 4:
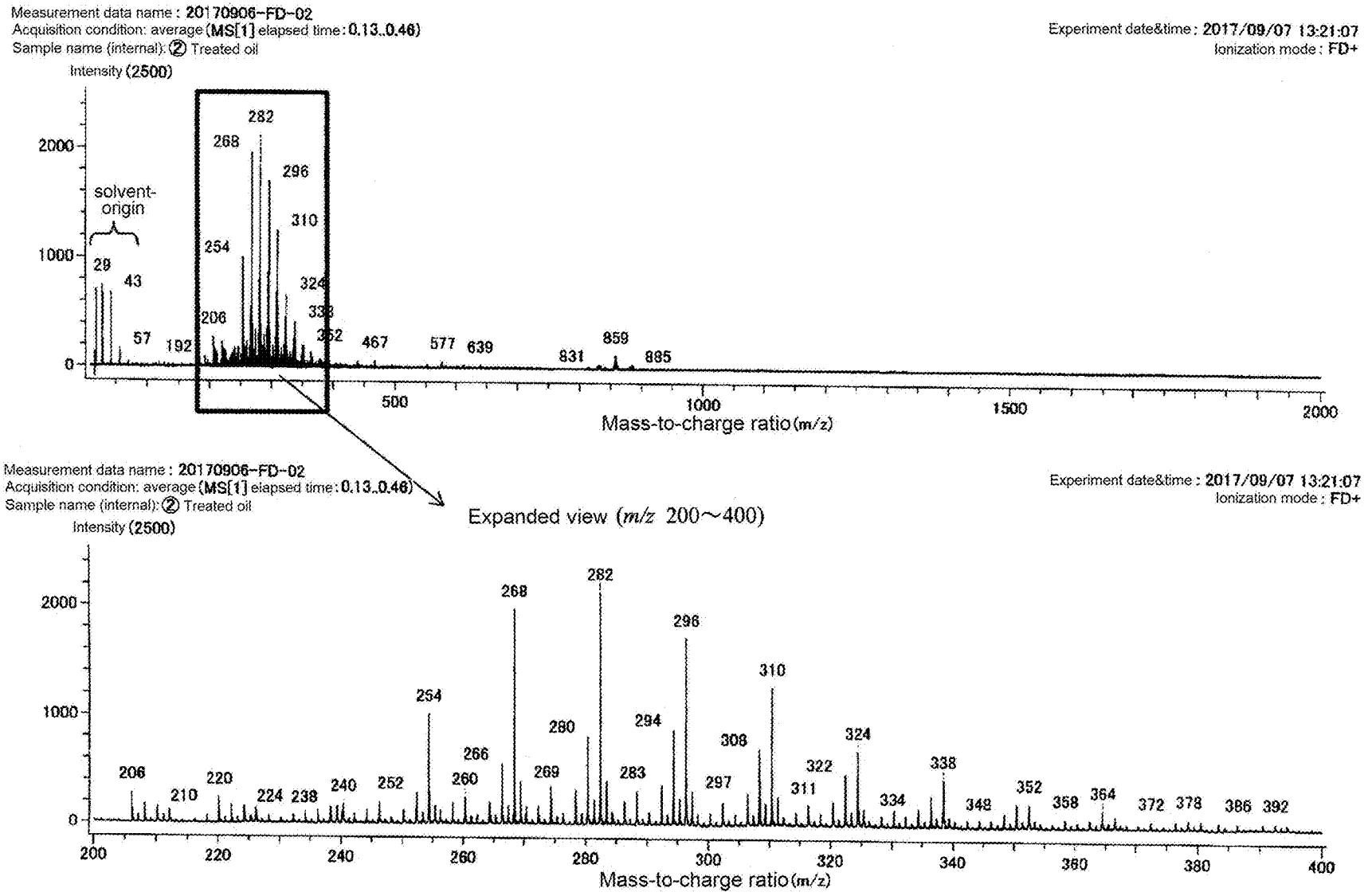
Figure 5:
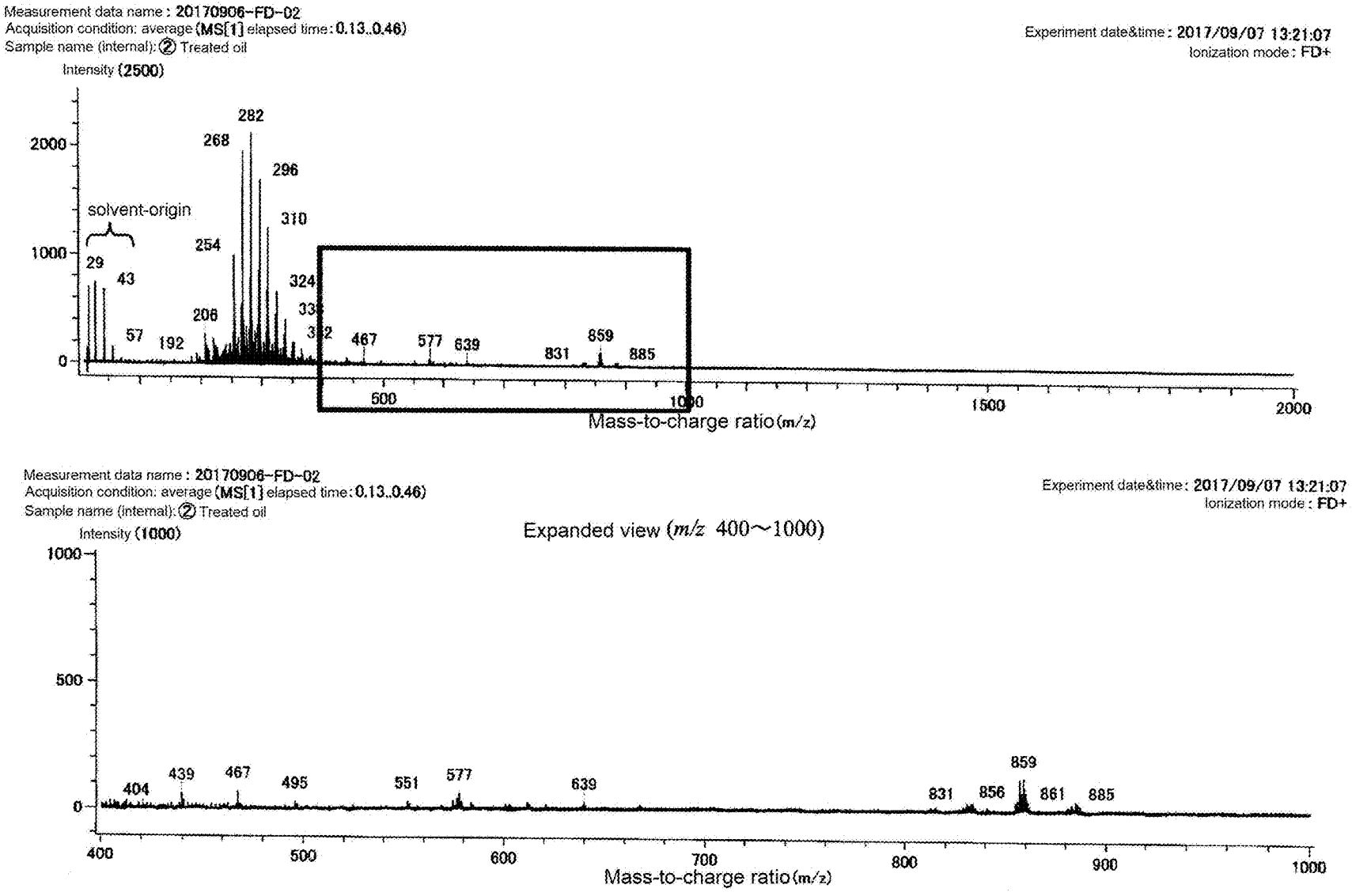

The FD-MS analysis charts obtained (spectrum peaks) are shown in FIGS. 1 to 5. FIGS. 1 and 2 represent a spectrum for the "A" heavy oil sample and an expanded view of the spectrum in the m/z 200-400 range. FIGS. 3 and 4 represent a spectrum for the product oil sample and an expanded view of the spectrum in the m/z 200-400 range. FIG. 5 represents a spectrum for the product oil sample and an expanded view of the spectrum in the m/z 400-1000 range.

Further, the number average molecular weight (Mn) and the weight average molecular weight (Mw) were calculated from the heights of the peaks detected in the m/z 100-500 range. The results are shown in Table 4 below.

TABLE 4

| Sample | Number average mol. wt. (Mn) | Weight average mol. wt. (Mw) |
|---|---|---|
| 'A' Heavy Oil | 284 | 290 |
| Example product oil | 280 | 284 |

When the petroleum-based combustible oil of the starting material and the product oil obtained by the inventive method were compared, the major peaks seen in the m/z range below 400 were similar, and the average molecular weights were also not significantly different, suggesting that the two oils have largely similar hydrocarbon compositions (FIGS. 1 to 4, Table 4). The product oil sample showed several small peaks in the m/z 400-900 range, which were not seen in the 'A' heavy oil sample (FIG. 5).

Further, a sample of the product oil obtained as in Examples 16 to 25 was submitted to the Nippon Kaiji Kentei Kyokai (Japan maritime affairs test association) for the analysis of the general properties. A copy of the test report thus obtained is shown in FIG. 6. In the test report, the sample of the starting material 'A' heavy oil is referred to as "'A' Heavy Oil" and the sample of the product oil is referred to as "Fuel Oil (Clean Oil 'A' Heavy Oil)". Some parts of this copy including the contact information of the Nippon Kaiji Kentei Kyokai have been blacked out. The Nippon Kaiji Kentei Kyokai only carried out the analysis of the samples on commission and had no knowledge of the present patent application or how the samples had been prepared.

The results of FIG. 6 demonstrate that the product oil has the properties substantially similar to those of the 'A' heavy oil, and the product oil is useful as a fuel just like the original oil of the starting material.

INDUSTRIAL APPLICABILITY

The present invention can be utilized in any industrial sectors which use the petroleum-based combustible oils. The present invention has a potential to contribute to the society at large which depends on the petroleum-based combustible oils as a source of energy.

The invention claimed is:

1. A method of preparing a combustible oil, the method comprising adding and mixing:

a petroleum-based combustible oil;

a water having an oxidation-reduction potential of −300 mV or lower, a pH of 9.0 or higher, and a dissolved hydrogen concentration of 0.8 ppm or higher;

a fatty oil; and an activated carbon to obtain a mixture, and removing solids from the mixture to obtain an oil phase as a product oil.

2. The method of preparing a combustible oil according to claim 1, wherein the amount of the water added is 5 to 60% by volume relative to 100% of the total volume of the petroleum-based combustible oil and the water.

3. The method of preparing a combustible oil according to claim 1, wherein the adding and mixing to obtain the mixture further comprises adding magnesium chloride.

4. The method of preparing a combustible oil according to claim 3, wherein the amount of the magnesium chloride added is 0.005 to 0.5% (w/v) in terms of an anhydrous equivalent, relative to the water.

5. The method of preparing a combustible oil according to claim 1, wherein the fatty oil comprises a vegetable oil.

6. The method of preparing a combustible oil according to claim 1, wherein the fatty oil comprises a glyceride of an unsaturated fatty acid.

7. The method of preparing a combustible oil according to claim 1, wherein the amount of the fatty oil added is 0.5 to 10 parts by volume relative to 100 parts of the total volume of the water and the petroleum-based combustible oil.

8. The method of preparing a combustible oil according to claim 1, wherein the activated carbon is a particulate activated carbon having a particle size smaller than 16 mesh.

9. The method of preparing a combustible oil according to claim 1, wherein the amount of the activated carbon added is 0.1 to 5% (w/v) relative to the total volume of the water and the petroleum-based combustible oil.

10. The method of preparing a combustible oil according to claim 1, wherein the adding and mixing to obtain the mixture further comprises adding a carbon nanotube.

11. The method of preparing a combustible oil according to claim 1, wherein the adding and mixing to obtain the mixture comprises adding a partial mixture comprising a portion of the petroleum-based combustible oil and the activated carbon.

12. The method of preparing a combustible oil according to claim 11, wherein the water, the partial mixture, and the fatty oil are added and mixed, and then the remainder of the petroleum-based combustible oil is added and mixed stepwise.

13. The method of preparing a combustible oil according to claim 1, wherein the obtaining the oil phase as the product oil further comprises separating the oil phase and an aqueous phase to obtain the oil phase as the product oil.

14. A method of preparing a combustible oil, the method comprising:

adding and mixing:

a petroleum-based combustible oil;

a water having an oxidation-reduction potential of −300 mV or lower, a pH of 9.0 or higher, and a dissolved hydrogen concentration of 0.8 ppm or higher;

a fatty oil; and an activated carbon to obtain a mixture, and removing solids from the mixture to obtain:

an oil phase as a product oil; or an oil phase as a product oil and an aqueous phase;

wherein the solids include the activated carbon.

15. A method of preparing a combustible oil, the method comprising:

adding and mixing:

a petroleum-based combustible oil having a first volume;

a water having an oxidation-reduction potential of −300 mV or lower, a pH of 9.0 or higher, and a dissolved hydrogen concentration of 0.8 ppm or higher;

a fatty oil having a second volume; and an activated carbon to obtain a mixture, and removing solids from the mixture to obtain an oil phase as a product oil having a third volume;

wherein the solids include the activated carbon; and wherein the third volume of the oil phase is larger than a total of the first volume of the petroleum-based combustible oil and the second volume of the fatty oil.

16. The method of preparing a combustible oil according to claim 15, wherein, after removing the solids, the water is dispersed, suspended, or dissolved in the oil phase, in an aqueous phase, or any combination thereof.

17. The method of preparing a combustible oil according to claim 15, wherein the adding and mixing to obtain the mixture further comprises adding magnesium chloride.

18. The method of preparing a combustible oil according to claim 15, wherein the amount of the fatty oil added is 0.5 to 10 parts by volume relative to 100 parts of the total volume of the water and the petroleum-based combustible oil.

19. The method of preparing a combustible oil according to claim 15, wherein the adding and mixing to obtain the mixture further comprises adding a carbon nanotube.

20. The method of preparing a combustible oil according to claim 15, wherein the adding and mixing to obtain the mixture comprises adding a partial mixture comprising a portion of the petroleum-based combustible oil and the activated carbon.

* * * * *